US008322396B2

(12) United States Patent
Andersen et al.

(10) Patent No.: US 8,322,396 B2
(45) Date of Patent: Dec. 4, 2012

(54) SCREENING ARRANGEMENT HAVING AN END PIECE WITH AN INTEGRATED ROLLER SHAFT

(75) Inventors: Hans Gram Andersen, Tønder (DK); Steffen Stenulm, Skjern (DK)

(73) Assignee: VKR Holding A/S, Hoersholm (DK)

( * ) Notice: Subject to any disclaimer, the term of this patent is extended or adjusted under 35 U.S.C. 154(b) by 30 days.

(21) Appl. No.: 12/451,073

(22) PCT Filed: Apr. 26, 2007

(86) PCT No.: PCT/DK2007/050045

§ 371 (c)(1), (2), (4) Date: Dec. 31, 2009

(87) PCT Pub. No.: WO2008/131757

PCT Pub. Date: Nov. 6, 2008

(65) Prior Publication Data

US 2010/0116444 A1 May 13, 2010

(51) Int. Cl.
*A47G 5/02* (2006.01)

(52) U.S. Cl. ..... 160/313; 160/318; 160/23.1; 160/323.1

(58) Field of Classification Search ..... 160/31, 160/323.1, 239, 313, 318, 24, 23.1; 403/295
See application file for complete search history.

(56) References Cited

U.S. PATENT DOCUMENTS

| | | | | |
|---|---|---|---|---|
| 4,126,174 | A * | 11/1978 | Moriarty et al. | 160/266 |
| 4,610,292 | A * | 9/1986 | Hausmann et al. | 160/120 |
| 4,944,341 | A * | 7/1990 | Trippner et al. | 160/98 |
| 6,446,696 | B1 * | 9/2002 | Davies et al. | 160/243 |
| 6,701,994 | B2 * | 3/2004 | Goldenberg et al. | 160/31 |
| 2006/0000559 | A1 * | 1/2006 | Bohlen | 160/31 |
| 2007/0284053 | A1 * | 12/2007 | Mullet et al. | 160/31 |

FOREIGN PATENT DOCUMENTS

| | | |
|---|---|---|
| DE | 202005020671 | 5/2006 |
| FR | 2430551 | 2/1980 |
| WO | WO 00/47858 | 8/2000 |
| WO | WO 2005/008013 A1 | 1/2005 |
| WO | WO 2006/048014 A1 | 5/2006 |

* cited by examiner

*Primary Examiner* — Blair M. Johnson
(74) *Attorney, Agent, or Firm* — Merek, Blackmon & Voorhees, LLC

(57) ABSTRACT

In a screening arrangement comprising a top element, a bottom element, and a screening body, the top element includes two end pieces (410) and a spring-biased roller bar mounted on a roller shaft (461). The roller shaft (461) and one of the end pieces (410) constitute an integral one-piece unit formed by molding.

18 Claims, 6 Drawing Sheets

SCREENING ARRANGEMENT HAVING AN END PIECE WITH AN INTEGRATED ROLLER SHAFT

The present invention relates to a screening arrangement for screening an aperture of a frame, comprising: a top element, a bottom element, and a screening body, said screening body including a first end edge, a second end edge and two side edges, said first end edge being accommodated in the top element and the second end edge fastened to the bottom element, said bottom element being movable between a non-screening position close to the top element and a screening position at a distance from the top element, said top element including two end pieces and a spring-biased roller bar acting toward moving the screening body to said non-screening position, said roller bar being mounted on a roller shaft.

In such screening arrangements the roller bar rotates during unrolling and rolling-up of the screening body. Traditionally, the roller bar is formed as a tubular cylindrical bar supported at its two ends by means of bearings mounted on a roller shaft and a stub shaft, respectively. In turn, the roller shaft and the stub shaft are connected with bracket members on the frame, possibly via coupling members. The spring-bias is provided by a torsion spring secured at one end to the roller shaft and at the opposite end to the inner wall of the tubular roller bar. As the end of the roller shaft is restrained from rotation, the spring is preloaded, i.e. biased toward the non-screening position during unrolling of the screening body. In its most simple form the restraint from rotation is provided by forming the roller shaft with a polygonal cross-section, e.g. a rectangular cross-section. Although the structure of such arrangements has proven to function well, the number of parts to be connected with each other renders the assembly time-consuming and costly.

FR-A-2 430 511 discloses a screening arrangement, in which a cross-sectionally circular roller shaft is connected with a restraint element, e.g. by means of welding. The restraint element is, in turn, secured to a flange constituting one end piece of the top element of the screening arrangement by means of screws. Although this arrangement provides for a reduced number of parts having to be assembled once the roller shaft is connected with the restraint element, the connection between the roller shaft and the restraint element is complicated. Furthermore, the connection may constitute a point of weakness. This might be critical, as the torsion forces to be transferred from the roller shaft to the restraint element during unrolling of the screening body may be considerable. At worst this may cause destruction of the connection and hence of the screening arrangement.

With this background it is the object of the invention to provide a screening arrangement, which provides for a simplified assembly of the screening arrangement, and in which the strength of the screening arrangement is not impaired.

This and further objects are met by the provision of a screening arrangement of the kind mentioned in the introduction, which is furthermore characterized in that said roller shaft and one of the end pieces constitute an integral unit provided as a one-piece moulded unit.

With the integration of the roller shaft and the end piece in a one-piece unit, the need for complicated connections at this point is rendered superfluous. The reduction of the number of parts entails that the simplified assembly aimed at is obtained and, simultaneously, a very strong transition between the roller shaft and the end piece is provided. In turn, the integral transition makes it possible to make the roller shaft slimmer. Consequently, the roller bar may be made with a smaller diameter, and hence the entire top element may be formed with smaller overall dimensions.

As a supplementary advantage, the spatial requirements at the ends of the top element at the end piece/roller shaft transition are reduced. The additional space thus obtained may for instance be utilized to make the screening body wider. This is an advantage from an aesthetical point of view in any screening arrangement. However, in case of screening arrangements functioning as blackout blinds, it is a requirement that the gap between the side edges of the screening body and the frame pieces be covered. This is, most often, achieved by means of side rails. When using the screening arrangement according to the invention as a blackout blind, the width of these side rails may be reduced, which in addition to providing a more pleasant appearance provides for a reduced material consumption.

In an embodiment, which provides for an even larger reduction in the number of parts to be assembled, the integral unit includes coupling means adapted to be connected with a bracket member provided in the frame aperture.

Preferably, the coupling means are formed on the outer side of the end piece and comprise an upper guide surface and a lower guide surface formed on a respective upstanding rib on the end piece itself. In addition to providing the guide surfaces, the ribs act as a reinforcement of the end piece. Additionally, this makes it possible to increase the width of the screening body even further, as no separate coupling member needs be connected to the screening arrangement.

In order to facilitate the mounting, the lower guide surface may be provided with a ramp.

Mounting of the screening arrangement is particularly easy in an embodiment in which the top element is retained temporarily by coupling means including resilient engagement means.

Preferably, the resilient engagement means include a tongue extending from a point at the back of end piece in the direction towards the front such that one portion of the tongue has a direction substantially parallel with that of the ramp on the lower guide surface and one portion is substantially parallel with the guide surfaces.

Permanent retention is facilitated by an embodiment, in which the coupling means comprise snap engagement means including a retaining pawl.

Furthermore, the end piece may be provided with spring means adapted to be connected to a side rail.

The outer side of the other end piece may be formed in a substantially identical, however mirror-inverted manner as the end piece integral with the roller shaft.

Preferably, the integral unit and the other end piece each includes means for receiving the bearings of a guide roller.

The qualities of easy assembly and security against failure of the screening arrangement are improved even further in a structurally simple embodiment, wherein a spring device providing the spring bias includes a torsion spring securely fastened, in one end, to an end plug having a bearing ring freely rotatable on said roller shaft, and, in the other end, secured in a slit in the roller shaft. Preferably, the retention of the torsion spring in the slit is secured by means of a support element.

Advantageously, the other end piece, i.e. the end piece opposite to the one end piece integral with the roller shaft, is provided as a moulded piece.

The integral unit, and possibly the other end piece formed by moulding, are preferably moulded from a plastic material, such as polyamide or polyethylene.

In one embodiment, the top element is provided with such dimensions that a top edge of the bottom element is adapted to overlap, in the non-screening position, a bottom edge of a front side of the top element slightly.

In a further embodiment, the screening arrangement further comprises a guide bar, and the screening body is wound in mutually opposite directions on the roller bar and the guide bar, and that the front side of the screening body faces inwards on the roller bar in the non-screening position.

A particularly compact design is provided for by an embodiment in which the top element includes two end pieces, wherein the roller bar is spring-biased and mounted on a roller shaft, and wherein said roller shaft and one of the end pieces constitute an integral unit provided as a one-piece moulded unit. With the integration of the roller shaft and the end piece in a one-piece unit, the need for complicated connections at this point is rendered superfluous. The reduction of the number of parts entails that the simplified assembly aimed at is obtained and, simultaneously, a very strong transition between the roller shaft and the end piece is provided. In turn, the integral transition makes it possible to make the roller shaft slimmer. Consequently, the roller bar may be made with a smaller diameter, and hence the entire top element may be formed with smaller overall dimensions. As a supplementary advantage, the spatial requirements at the ends of the top element at the end piece/roller shaft transition are reduced. The additional space thus obtained may for instance be utilized to make the screening body wider. This is an advantage from an aesthetical point of view in any screening arrangement.

However, in case of screening arrangements functioning as blackout blinds, it is a requirement that the gap between the side edges of the screening body and the frame pieces be covered. This is, most often, achieved by means of side rails. When using the screening arrangement according to the invention as a blackout blind, the width of these side rails may be reduced, which in addition to providing a more pleasant appearance provides for a reduced material consumption. In one embodiment of such a screening arrangement, the top rail extends in said first longitudinal direction between a first mitred end and a second mitred end, and wherein the screening arrangement further comprises two side rails, each of said side rails having a first end and second mitred end, the second mitred end of each side rail being adapted to be joined to the first and second mitred end, respectively, of said top rail, and that the screening arrangement furthermore includes a set of angular brackets, each angular bracket being adapted to cooperate with reception means in the back side of the top rail and in the back side of the respective side rail.

Preferably, the top rail has a predetermined height and each side rail has a predetermined width, and wherein said predetermined height is substantially the same as said predetermined width, the mitre joint thus being a 45° mitre joint. This provides for a particularly harmonic overall appearance of the screening arrangement. As the top rail may be formed with a small predetermined height due to the compact design and optimum utilization of the space available in the top element, the three elements visible from inside the room render the screening arrangement slender, elegant and inconspicuous.

In the following the invention will be described in further detail by means of examples of embodiments with reference to the schematic drawings, in which FIG. 1 is a perspective view of a window provided with a screening arrangement in an embodiment of the invention;

Figure 1:
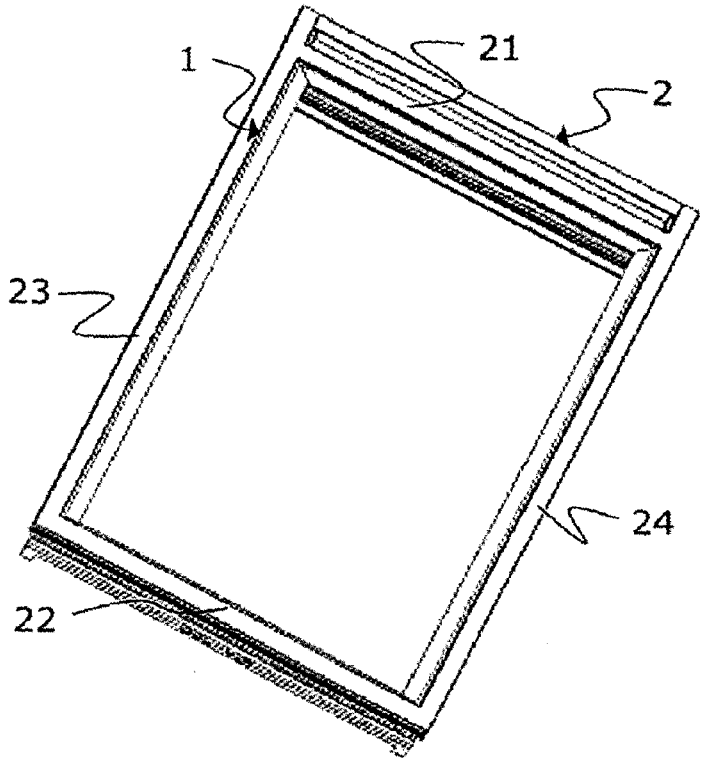
Figure 2:
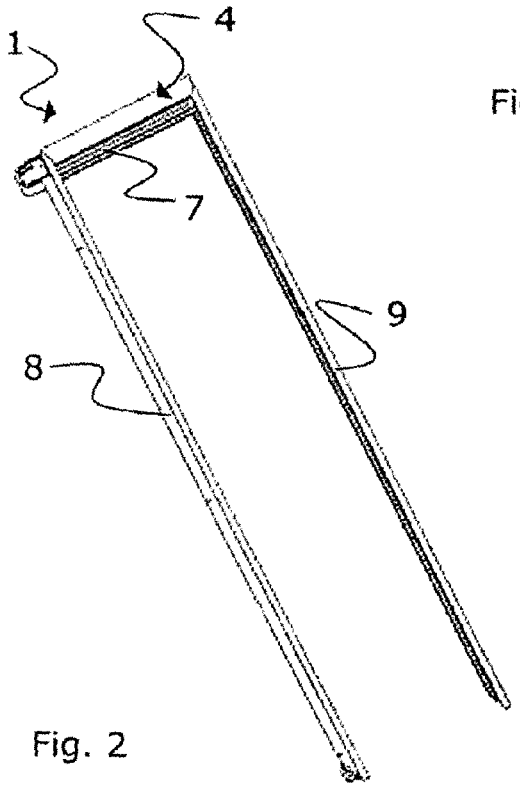
FIG. 2 is a perspective view of the screening arrangement shown in FIG. 1.

FIGS. 1 and 2 show an embodiment of a screening arrangement generally designated 1. As shown in FIG. 1, the screening arrangement is adapted to be mounted on a frame constituted by a sash 2 representing a window. The sash 2, in turn, is adapted to be connected with a stationary frame (not shown), which in a mounted position of the window lines an opening in a building. It is noted that the term "frame" is to be understood as incorporating any substantially rectangular structure positioned in any opening in a building, whether in a wall or the roof, and surrounding an aperture to be screened. Although the sash shown in FIG. 1 is the sash of a roof window and the screening arrangement 1 is mounted on the sash 2 of the window, a screening arrangement according to the invention may just as well be mounted on the stationary frame instead of the sash and may also be utilized in connection with e.g. windows having a frame only, or in doors.

The sash 2 has a top piece 21, a bottom piece 22 and two side pieces 23 and 24 surrounding an aperture, which is covered by a suitable panel element such as a glazing in the form of an insulating pane (not shown). In the embodiment shown, the screening arrangement 1 comprises a top element 4 positioned at the sash top piece 21, a screening body 6 (not shown in FIG. 1 or 2, cf. however FIG. 13) and a bottom element 7. At its upper end edge, the screening body 6 is accommodated in the top element 4 and its opposed, lower end edge is fastened to the bottom element 7. In the embodiment shown, the bottom element 7 is adapted to act as a handle during operation of the screening arrangement 1, i.e. when moving the bottom element 7 and hence the screening body 6 between the non-screening position shown in FIGS. 1 and 2 and a screening position, in which the screening body 6 covers the sash aperture partly or fully. However, instead of being manually operated, the screening arrangement may be operated by other means, e.g. by electrical operating means.

Furthermore, the screening arrangement 1 comprises two side rails 8 and 9 adapted to be connected to a respective side piece 23 and 24 and to the top element 4, in a manner to be described in further detail below. In the mounted position of the screening arrangement 1, opposite ends of the bottom element 7 and opposite side edges of the screening body 6 are guided in these side rails 8 and 9. In the embodiment shown, the screening arrangement comprises a roller blind having as its screening body 6 a cloth or fabric, and of which the top element 4 includes a spring-biased roller bar. However, other screening arrangements having other kinds of screening bodies and other configurations of the top element are conceivable as well.

Figure 3:
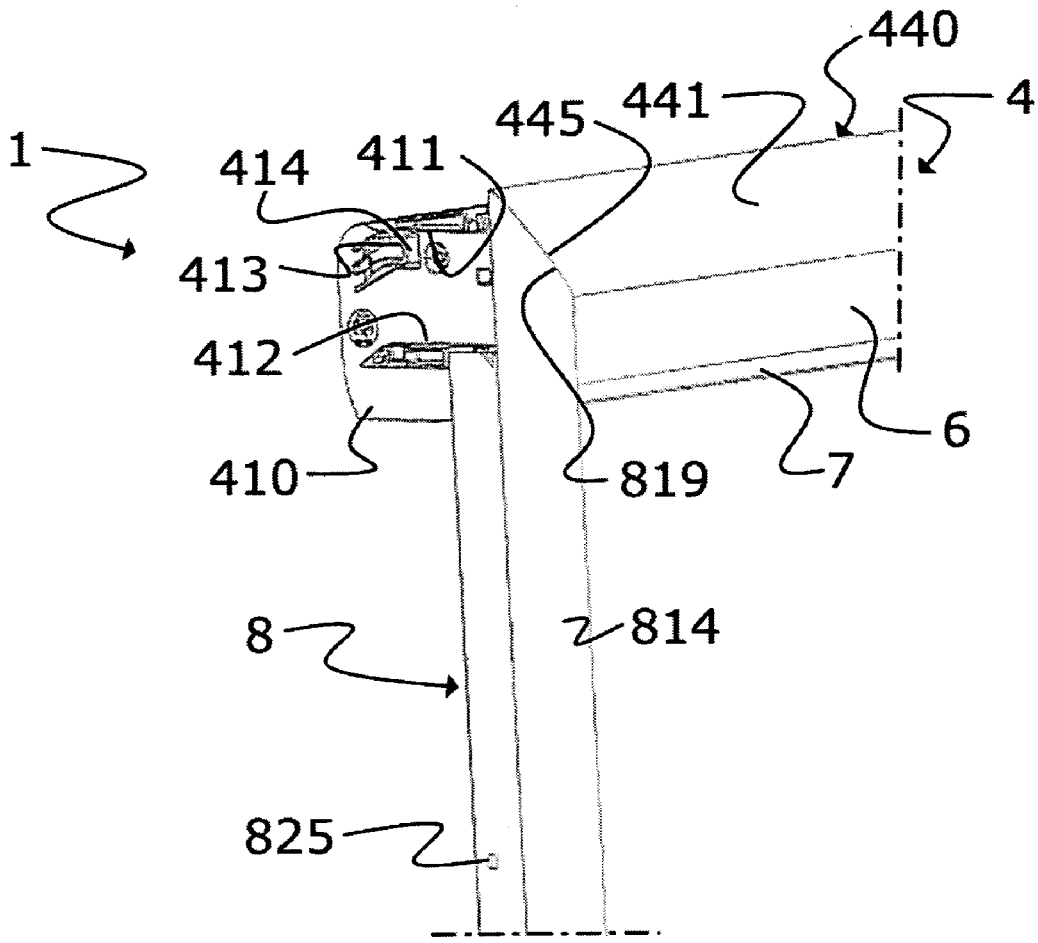
FIG. 3 shows, on a larger scale, a partial perspective view of a detail of the screening arrangement in an embodiment of the invention.
Figure 4:
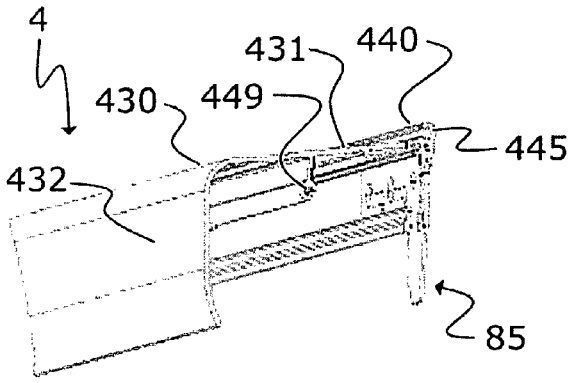
FIG. 4 shows, on a still larger scale, a perspective view of a part of the detail of the screening arrangement shown in FIG. 3.
Figure 6:
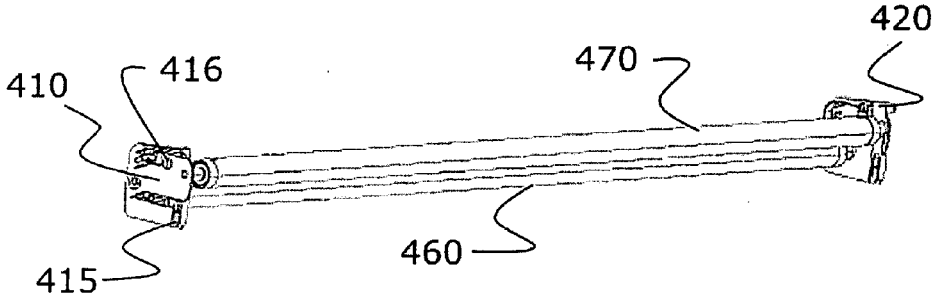
FIG. 6 shows, on a larger scale, a perspective view of a detail of the screening arrangement in an embodiment of the invention.
Figure 14:
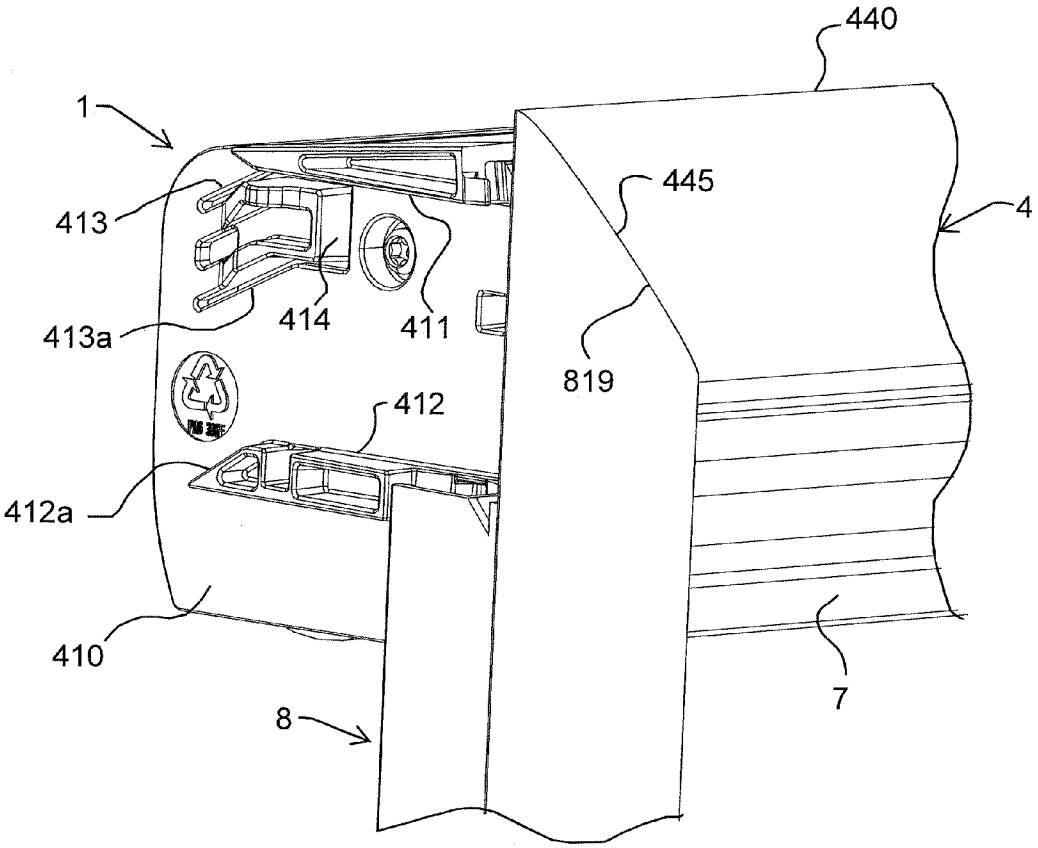
FIG. 14 is an enlarged partial perspective view of the detail of the screening arrangement of FIG. 3.

Turning now to FIGS. 3, 4 and 14 depicting the top element 4 in one embodiment of the screening arrangement, it may be seen that the top element 4 has a left-hand end piece 410 and a right-hand end piece 420 (not shown in these Figures, cf., however, FIG. 6). The terms "left-hand" and "right-hand" refer to the orientation shown in for instance FIGS. 1 to 3 and 14, and are utilized for reasons of convenience only. Similarly, the terms "front" and "back" are utilized to denote the sides of the screening arrangement, "front" being the side intended to face inwards into the room of the building, and "back" the outwards facing side.

The top element 4 comprises a cover 430 extending almost throughout the entire length of the top element 4 from the left-hand end piece 410 to the right-hand end piece 420, the end pieces thus constituting the end faces of the top element 4. At the side intended to face inwards into the room, i.e. the front side, the cover 430 is connected to a top rail 440. In the embodiment shown, the connection between the top rail 440 and the remaining portion of the top element, i.e. the cover 430 is made integral, e.g. by extruding the top element as a profile including the cover 430 as well as the top rail 440. The end piece 410 is adapted to be fastened to the cover 430 by means of e.g. a screw inserted in screw hole 416 (cf. FIG. 6) to be received in threaded track 449 in the cover 430. The top rail 440 has a slightly longer extension in the longitudinal direction than the cover portion 430.

Figure 5:
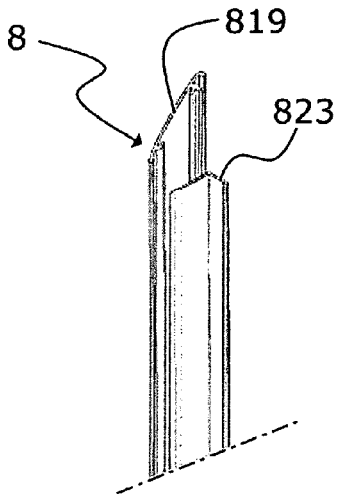
FIG. 5 shows, on a still larger scale, a partial perspective view of a detail of the screening arrangement in an embodiment of the invention.

In the mounted position of the screening arrangement the top rail 440 is joined to side rails 8, 9 in mitre joints by means of angular brackets 85. To that end the top rail 440 has two mitred ends, of which one mitred end 445 is shown in FIGS. 3, 4 and 14 to be joined to a respective mitred end of the side rails. In FIG. 5, the left-hand side rail 8 is shown with its mitred end 819. The side rail 8 furthermore has a flange 823 ending at a distance from the mitred end 819. This difference, in combination with the difference in length between the top rail 440 and the cover portion 430, leaves room for the end piece 410.

Just as the top rail 440 has a predetermined height, each side rail 8, 9 has a predetermined width, and in the embodiment shown the predetermined height is substantially the same as said predetermined width, the mitre joint thus being a 45° mitre joint. Other angles are conceivable, however, this entails that a similar configuration of the front sides of the three elements, i.e. top rail and two side rails, is not achievable.

The side edges of the screening body 6 are guided in the side rails 8, 9 in a manner known per se, for instance by means of a number of guide beads mounted at a distance from each other along each side edge. Hence, the side rails 8, 9 serve the purpose of improving the light-proofing properties of the screening arrangement, as they overlap the side edges of the screening body in the mounted position of the screening arrangement. Eventually, depending on the type of screening body and the installation situation, the side rails may contribute to holding the screening body in position. The bottom edge of the screening body 6 is connected with the bottom element 7 in any suitable manner, and the ends of the bottom element 7 are advantageously guided in the side rails as well. In order to improve the lightproof qualities even further the bottom element 7 may be provided with a sealing profile 73 (cf. FIG. 13) to abut against the bottom side piece of the frame.

Eventually, the screening arrangement comprises a parallel guidance cord system comprising two cords (not shown), one cord being adapted to extend from the left-hand lower corner of the sash, up through or along the bottom element 7 and further up to the top element 4. The other cord is routed in a mirror-inverted manner. At the top element 4, each cord is connected with a respective pre-tensioning device adapted to be connected with the top element 4 in a track and/or to press against the top cover portion 431 of the cover 430. The pre-tensioning devices entail that the cords are held at a suitable tension all of the time, thereby ensuring that the bottom element 7 is at all times kept substantially in parallel with the top and bottom pieces 21, 22 of the sash 2 during operation of the screening arrangement. In the mounted position, the cords are hidden behind the side rails.

Figure 7:
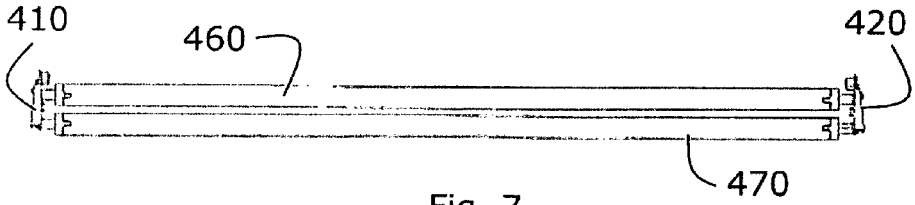
FIG. 7 shows a view of the screening arrangement detail of FIG. 6 seen from the above.
Figure 8:
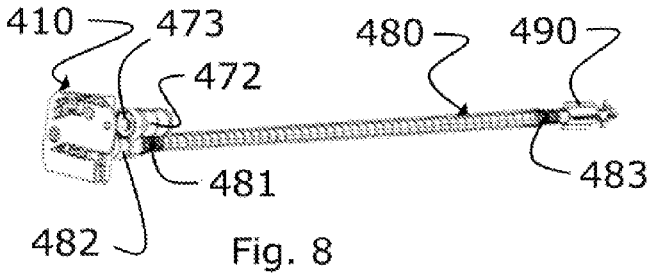
FIGS. 8, 9 and 10 show perspective views of details of the screening arrangement of FIGS. 6 and 7.
Figure 9:
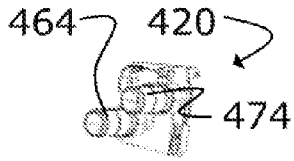
Figure 10:
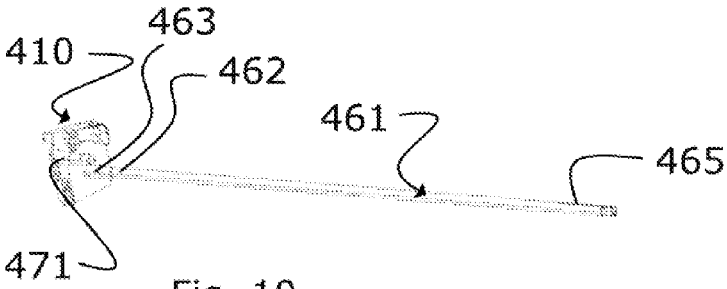
Figure 11:
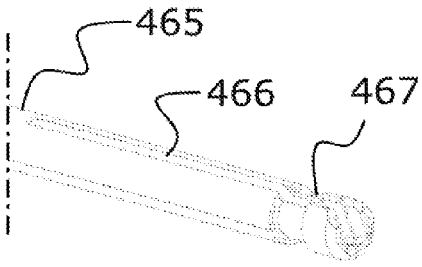
FIGS. 11 and 12 show, on a larger scale, partial perspective views of details of the screening arrangement of FIGS. 6 and 7.
Figure 12:
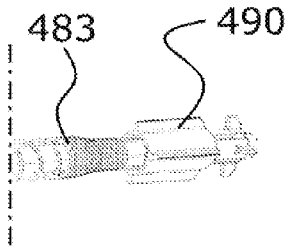
Figure 13:
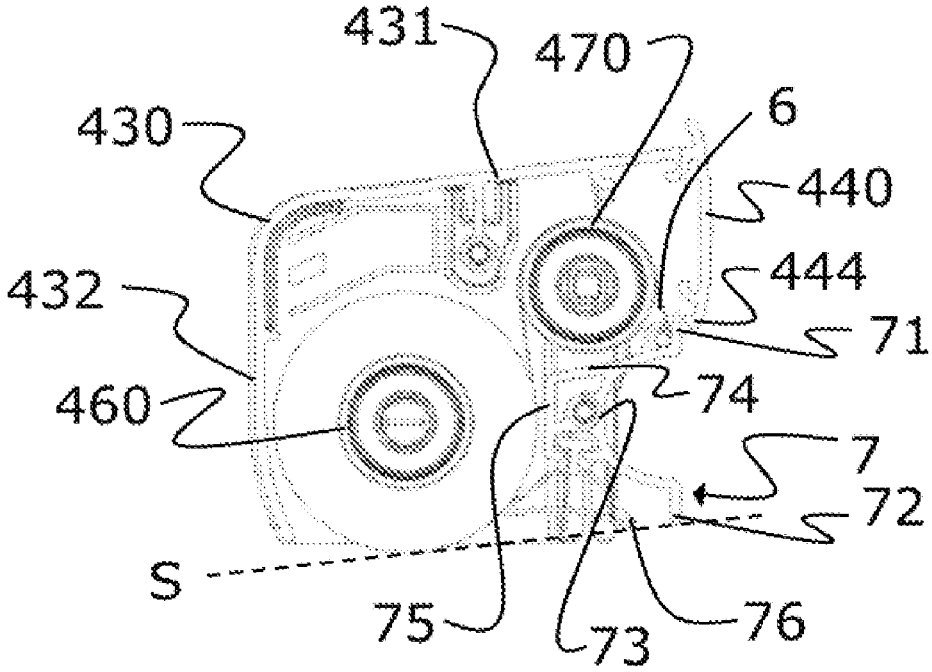
FIG. 13 shows, on a still larger scale, an end view of details of the screening arrangement in one embodiment.

As may be seen most clearly from the partial perspective view of FIG. 6 and the plane view of FIG. 7, in which the screening body 6 and the bottom element 7 are not shown for clarity reasons, the top element 4 accommodates a guide bar 470 and a roller bar 460. The screening body 6 is fastened to the roller bar 460 along its upper end edge in any suitable manner known per se. The guide bar 470 guides the screening body 6 onto the roller bar 460, which serves to collect and store the screening body 6 in the non-screening and partially screened positions of the screening arrangement, or even in the fully screened position, in case the screening body contains surplus material. As shown in FIG. 13, the screening body is wound in mutually opposite directions on the roller bar and the guide bar. Furthermore, the roller bar 460 is spring-biased and, hence, provides the preload toward the non-screening position required to roll up the screening body 6. Although not visible in FIGS. 6 and 7, it is noted that the screening body 6 extends almost up to the inner side of the end pieces 410, 420, thus providing for an optimum usage of the space available also in the longitudinal direction of the top element 4. The preload acting on the roller bar 460 is provided by a spring device that will be described in further detail below during the description of FIGS. 8 to 12. The roller bar 460 and the guide bar 470 are formed as hollow cylindrical bodies. For instance, the roller bar 460 and the guide bar 470 may be more or less identical, both as regards length, diameter and material thickness. For instance, the diameter of the roller bar 460, and of the guide bar 470, may be approximately 12-20 mm, e.g. 16 mm. However, different configurations between the two bars are conceivable.

The guide bar 470 serves three primary purposes: Firstly, it ensures that the screening body 6 is guided in substantially the same screening plane along the height of the sash aperture. On the roller bar 460, the total external diameter of the roller bar 460 and the stored portion of the screening body 6 varies with the length of screening body unrolled. In screening arrangements not provided with a guide bar or other guide means, this entails that the screening body unrolled from the roller bar in a fully or almost fully screened position is positioned close to the roller bar and hence a distance from the side rails. The provision of the guide bar 470 eliminates the effects of this diameter variation. Secondly, the guide bar 470 makes it possible to obtain a suitable tension of the screening body 6 to avoid wrinkles of the screening body and prevents that the screening body is rolled up askew. This effect is even more pronounced in one embodiment, in which the guide bar 470 has a configuration tapering towards each end. The tapering might for instance lie in the interval 2-5 mm per m length of the guide bar 470. Third, the side of the screening body 6 facing inwards in the screening positions, i.e. the front side facing towards the room in the position of use of the screening arrangement, faces inwards when stored on the roller bar 460 and, consequently, the back side faces outwards on the roller bar. In this manner, the front side of the screening body is protected from light when rolled up on the roller bar. Hence, deterioration of the appearance of the front side is avoided or at least reduced to a considerable extent. In the embodiment shown, in which the top element 4 has a top side and a back side constituted by the cover 430, the roller bar 460 is positioned closer to the back cover portion 432 than the guide bar 470, whereas the guide bar 470 is positioned closer to the top cover portion 431 than the roller bar 460. This reduces the portion of the screening body exposed to light in the non-screening position to a minimum. In fact, it is an important feature of the spring device according to the invention that the top element 4 is of a compact design. This will be described in further detail following the below description of the remaining parts of the screening arrangement.

Referring now to the detailed description of FIGS. 8 to 12, it emerges that in the embodiment shown, a roller shaft 461 is integral with the left-hand end piece 410. Alternatively, the roller shaft 461 could be formed as an integral unit with the other, right-hand end piece 420. The integral connection is obtained by moulding the end piece 410 and the roller shaft 461 in one piece, i.e. without subsequent joining of any parts, to form the one piece unit comprising the end piece and the roller shaft. Preferably, the moulding is carried out by any appropriate method on the basis of a suitable plastic material, such as polyamide, for instance PA6, or polyethylene, which has a good durability against wear and tear, and sufficient resistance towards torsion and bending. The roller shaft 461 extends between a left hand end 462 joined to the end piece 410 by stub portion 463, and a right hand end 465. Preferably, the roller shaft 461 is formed as a solid body part. As can be appreciated by comparing FIG. 6 and FIG. 10, in which the end piece 410 is shown on the same scale, the roller shaft 461 extends at least most of the length of the roller bar 460.

In the embodiment shown, a plurality of further functions is integrated into the end pieces. In addition to the above-described roller shaft 461 being integral with the left-hand end piece 410, it may be seen that the end piece 410 has a stub 471 acting as means for receiving bearings for one end (the left-hand end) of the guide bar 470, said bearings being constituted by end plug 472 having a bearing ring 473. The right-hand end piece 420 is provided with a stub (not shown) similar to stub 471 for receiving the bearings for the right-hand end of the guide bar 470 in the form of end plug 474 and a bearing ring corresponding to bearing ring 473. Furthermore, the right-hand end piece 420 is provided with a second stub (not shown) intended for receiving end plug 464 for supporting the right-hand end of roller bar 460. The left-hand end of roller bar 460 is supported on stub portion 463 by an end plug 482 of the spring device. The connection with the roller bar 460 may be carried out in any suitable manner, e.g. by means of a stepped portion of the end plug 482. Whereas the roller shaft 461 is, as mentioned in the above, preferably formed as a solid body part, stub 471 of left-hand end piece 410 and the not-shown stubs on righthand end piece 420 may be hollow. The retention of the roller bar and the guide bar on the respective end plugs may be carried out by friction alone, or by means of mechanical fastening means such as protruding portions of the end plugs interacting with apertures in the roller and guide bars, or vice versa. The roller shaft, stubs, bearings and spring device form part of the suspension arrangement of the roller bar and guide bar of the screening arrangement. The diameter of the roller shaft 461 may for instance lie in the interval 4-8 mm, e.g. 6 mm.

In the embodiment shown, the spring device generally designated 480 comprises a torsion spring extending between a left-hand end 481 securely fastened to end plug 482 and a right-hand end 483. As may be seen in the enlarged views of FIGS. 11 and 12, torsion spring end 483 is secured in a slit 466 in the right-hand end 465 of roller shaft 461. In the embodiment shown the slit 466 opens towards the top of the roller shaft 461 and extends towards the bottom thereof, ending at a certain distance from the bottom such that a bridge of material is still present at the bottom. The slit 466 could open in any direction and have other extensions in the radial direction, e.g. extend to the centre of the roller shaft 461. The retention of the torsion spring in the slit 466 is carried out by a bent portion (not shown) of the torsion spring end 483. Furthermore, retention is secured by means of support element 490, which has the additional function of preventing the roller shaft 461 from splitting open. The support element 490 is, in turn, retained on the roller shaft 461 by means of a groove 467 at the end 465 of roller shaft 461. The support means 490 has a maximum external diameter adapted to fit into the roller bar 460 in order to support the roller bar 460. It is to be understood that other kinds of spring devices may be utilized as well, e.g. spring devices making use of springs of other kinds than the shown torsion spring.

Returning now to FIGS. 3 and 14, a number of further functions built into the end pieces will be described in further detail. On the outer side, the end piece 410 comprises portions constituting coupling means for cooperation with bracket members positioned on the side piece 23 of the window sash 2. The opposite, right-hand end piece has an outer side configured in a substantially mirror-inverted manner. The bracket members may, in principle, have any suitable form as long as they permit swift and secure connection with the screening arrangement. One example of such bracket members is shown in Applicant's published international applications Nos WO 2005/008013 and WO 2006/048014, the contents of which are incorporated herein by reference. Such a coupling member is traditionally formed as a separate part connected with the remaining parts of the screening arrangement, one example being described in detail in Applicant's published international application No. WO 00/47858.

In the embodiment shown, the portions serving the function of coupling means corresponding to the coupling members of the prior art are made integral with the respective end pieces. These coupling portions are substantially identical, however mirror-inverted, on the lefthand end piece 410 and the right-hand end piece 420, and only the coupling portions of the left hand piece 410 will be described. Thus, the outer side of end piece 410 comprises an upper guide surface 411 and a lower guide surface 412 formed on a respective upstanding rib on the end piece 410 itself. In addition to providing the guide surface, the ribs act as a reinforcement of the end piece 410. The screening arrangement 1 has a general direction of mounting, as described in further detail in the above-mentioned Nos WO 2005/008013 and WO 2006/048014. The guide surfaces 411, 412 extend in parallel with that general direction of mounting. At one end, the lower guide surface 412 is formed with an inclined portion forming a ramp 412*a*. The ramp 412*a* is formed at the end intended to be positioned at the back when mounted, and is thus the end which is first brought into contact with the bracket member. The ramp 412*a* thus serves to facilitate correct positioning of the top element 4 of the screening arrangement. At the upper guide surface 411 resilient engagement means are provided. These means comprise a tongue 413 extending from a point at the back of end piece 410 in the direction towards the front such that one portion, i.e. back portion 413*a*, of the tongue has a direction substantially parallel with that of the ramp 412*a* on the lower guide surface and one portion is substantially parallel with the guide surfaces 411 and 412. This configuration facilitates the mounting even further. The resilient tongue 413 has the effect of allowing temporary positioning of the top element 4 on the bracket member. However, the tongue 413 furthermore includes snap engagement means in the form of upstanding retaining pawl 414 to allow for a more permanent retention of the top element in the frame. In this manner, the top element 4 is easily connected with the bracket members: Initially, the top element is moved generally in the mounting direction from inside the room towards the outside, i.e. towards the pane of the frame, however, slightly from below. Each end piece is guided onto the bracket member via the ramp 412*a* and the back portion 413*a* of tongue 413 during increased impression of the tongue 413. The tongue 413 thus exerts a corresponding resilient pressure on the bracket member resulting in a slightly clamping action on the top element. The top element is moved further on in the mounting direction with the guide surfaces 411, 412 in sliding engagement with the corresponding sides of the bracket member. When the top element 4 is almost at its final position, the retaining pawl 414 snaps out into engagement with an edge of the bracket member. The thickness of the end piece 410 itself, i.e. of the plane portion from which the roller shaft and the guide surfaces etc. mentioned in the above emanate, is relatively small, for instance 1-2 mm, e.g. 1.5 mm.

Furthermore, the end piece 410 has spring means 415 (cf. FIG. 6) for cooperation with a cord system of a further screening arrangement (not shown). Returning now to FIGS. 6 to 7, and referring in particular to FIG. 13, the compact design of the top element 4 will be described: In the embodiment shown the top element 4 has a front side, a top side and a back side. The front side is constituted by top rail 440, and the top and back sides by cover 430, i.e. by the top cover portion 431 and the back cover portion 432, respectively. It is conceivable to have a bottom side as well. Of course, such a bottom side could only cover a part of the distance from the back cover portion towards the screening plane in order not to come into conflict with the screening body 6.

The top element 4 is designed with such a height measured from the bottom of the back cover portion 432 to the top cover portion side 431 that it encloses a major part of the roller bar 460 including the screening body 6 stored on the roller bar 460 in the non-screening position.

Furthermore, the top element 4 is designed with such a depth measured from the top rail 440 to the back cover portion 431 that the bottom element 7 may be positioned at the same level of height as the roller bar 460 in the non-screening position. The bottom element 7 has a general U-shape, the legs of the U extending integrally into the top and bottom edges 71 and 72, respectively. As shown in FIG. 13, the top edge 71 of the bottom element 7 is positioned above bottom edge 444 of the top rail 440 of the top element 4 in the non-screening position. The bottom edge 72 is positioned at the same level as or slightly above the lowermost portion of the screening body 6 stored on the roller bar 460. In case the screening arrangement according to the invention is utilized to screen a window built-into an inclined roof surface, and the top of the window is positioned at a height corresponding to the line of sight S of a person standing in the room, the line of sight S extends at an angle other than perpendicular to the screening plane. Consequently, the roller bar 460 including the stored screening body 6 is hidden behind the bottom element 7. As is apparent from FIG. 13, the bottom element 7 has a general U-shape between the top and bottom edges 71, 72 comprising an integrally formed bar 74, 75 projecting in the direction facing the back cover portion 432, the finger grip 73 being provided by said U-shape. In the non-screening position, the top portion 74 of said bar is situated immediately below the guide bar 470 and the back portion 75 of the bar is situated immediately in front of the front portion of the screening body 6 stored on the roller bar 460. The slight overlap should not exceed the distance between the top edge 71 and the lower end of the U-shape and may for instance lie in the interval 1-10 mm, preferably 2-8 mm, most preferably 4-6 mm.

In combination, the height and depth dimensions and the particular positioning of the roller bar 460 and the guide bar 470 provide for an extremely compact design of the top element 4.

Installation of the entire screening arrangement 1 in a frame, for instance the sash 2 of FIG. 1, is carried out in the following manner:

The screening arrangement 1 may e.g. be delivered in a supply condition carried out at the manufacturer. In the supply condition, the angular brackets 85 are connected to the top rail 440 of the top element 4. At the installation site, the top element 4 is connected to the frame 2. In the embodiment shown, this is carried out in the manner described in the above by guiding the coupling members on the outer side of each end piece over the bracket members positioned at the upper ends of each side piece of the frame 2. Finally, the side rails 8,9 are joined to the top rail 440 at the mitred ends by means of the angular brackets. During the final step of joining the side rails to the top rail, each side rail is brought from a position, in which the side rail is out of alignment with the second longitudinal direction, to a position, in which the side rail is in alignment with the second longitudinal direction, during the step of connecting the side rails to the top rail. Subsequently, or simultaneously, each side rail is connected to the respective side piece of the sash or frame by means of suitable fastening means, e.g. screws inserted through aperture 825 and further similar apertures in the side rail.

The invention should not be regarded as being limited to the described embodiments. Several modifications and combinations of the different embodiments will be apparent to the person skilled in the art.

For instance, in screening arrangements having a large longitudinal extension there may be two spring devices. In this case, each end piece may be formed as an integral unit with a roller shaft. Obviously, the configuration of the two sides is mirror-inverted and the screening arrangement may e.g. comprise two torsion springs wound in opposite directions, or comprise springs of two different kinds.

LIST OF REFERENCE NUMERALS

1 screening arrangement
2 sash
  21 top piece
  22 bottom piece
  23 side piece
  24 side piece
4 top element
  410 left-hand end piece
  411 guide surface
  412 guide surface
  412*a* ramp
  413 tongue
  413*a* back portion
  414 retaining pawl
  415 spring means
  416 screw hole
  420 right-hand end piece
  430 cover
  431 top cover portion
  432 back cover portion
  440 top rail
  444 bottom edge
  445 first mitred end

449 track
460 roller bar
461 roller shaft
462 left-hand end of roller shaft
463 stub portion
464 end plug for roller bar, right-hand side
465 right-hand end of roller shaft
466 slit
467 groove
470 guide bar
471 stub
472 end plug for guide bar, left-hand side
473 bearing ring
474 end plug for guide bar, right-hand side
480 spring device
481 left-hand end of torsion spring
482 end plug of spring device
483 right-hand end of torsion spring
490 support element
6 screening body
7 bottom element
71 top edge
72 bottom edge
73 finger grip
74 top bar portion
75 back bar portion
76 sealing profile
8 side rail
819 mitred end
823 flange
825 aperture
85 angular bracket
9 side rail

The invention claimed is:

1. A screening arrangement (1) for screening an aperture of a frame, comprising:

a top element (4), a bottom element (7), and a screening body (6), said screening body including a first end edge, a second end edge and two side edges, said first end edge being accommodated in the top element and the second end edge fastened to the bottom element, said bottom element being movable between a non-screening position close to the top element and a screening position at a distance from the top element, said top element including two end pieces (410, 420) and a spring-biased roller bar (460) acting toward moving the screening body to said non-screening position, said roller bar being mounted on a roller shaft (461), wherein said roller shaft (461) and one of the end pieces (410) constitute an integral unit (410, 461) provided as a one-piece moulded unit, and wherein a spring device (480) providing the spring bias for the roller bar extends from adjacent to said one of the end pieces to adjacent to an end of the roller shaft distal to said one of the end pieces, the roller shaft extending beyond the spring device in a direction away from said one of the end pieces;

wherein the integral unit (410,461) includes coupling means adapted to be directly connected with a bracket member provided in the frame aperture.

2. A screening arrangement according to claim 1, wherein the coupling means are formed on the outer side of said one of the end pieces (410) and comprise an upper guide surface (411) and a lower guide surface (412) formed on a respective upstanding rib on said one of the end pieces (410) itself.

3. A screening arrangement according to claim 2, wherein the lower guide surface (412) is provided with a ramp (412*a*).

4. A screening arrangement according to claim 2, wherein the coupling means include resilient engagement means.

5. A screening arrangement according to claim 4, wherein said resilient engagement means include a tongue (413) extending from a point at the back of said one of the end pieces (410) in the direction towards the front such that one portion (413*a*) of the tongue has a direction substantially parallel with that of the ramp (412*a*) on the lower guide surface (412) and one portion is substantially parallel with the guide surfaces.

6. A screening arrangement according to claim 1, wherein the coupling means comprise snap engagement means including a retaining pawl (414).

7. A screening arrangement according to claim 1, wherein said one of the end pieces (410) is provided with spring means (415) adapted to be connected to a side rail (8).

8. A screening arrangement according to claim 1, wherein the outer side of the other end piece (420) is formed in a substantially identical, however mirror-inverted manner as the end piece (410) integral with the roller shaft (461).

9. A screening arrangement according to claim 1, wherein the integral unit (410, 461) and the other end piece (420) each includes means (471) for receiving the bearings of a guide roller (470).

10. A screening arrangement according to claim 1, wherein the spring device (480) providing the spring bias includes a torsion spring securely fastened, at one end (482), to an end plug having a bearing ring freely rotatable on said roller shaft, and, at the other end (483), secured in a slit (466) in the roller shaft.

11. A screening arrangement according to claim 10, wherein the retention of the torsion spring in the slit is secured by means of a support element (490).

12. A screening arrangement according to claim 1, wherein said integral unit (410, 461) is moulded from a plastic material.

13. A screening arrangement according to claim 1, wherein the other end piece (420) is provided as a moulded piece.

14. A screening arrangement according to claim 13, wherein said moulded piece is moulded from a plastic material.

15. A screening arrangement according to claim 1, wherein the top element (4) is provided with such dimensions that a top edge (71) of the bottom element (7) is adapted to overlap, in the non-screening position, a bottom edge (444) of the front side (440) of the top element (4) slightly.

16. A screening arrangement according to claim 1, wherein the screening arrangement further comprises a guide bar (470), and wherein the screening body (6) is wound in mutually opposite directions on the roller bar (460) and the guide bar (470), and wherein the front side of the screening body (6) faces inwards on the roller bar (470) in the non-screening position.

17. A screening arrangement according to claim 1, wherein said top element (4) is provided with a top rail (440) forming the front side of the top element and being connected to a cover (430) of the top element (4), said top rail (440) extending between a first mitred end and a second mitred end, and wherein the screening arrangement further comprises two side rails (8, 9), each of said side rails (8, 9) having a first end and second mitred end, the second mitred end of each side rail (8, 9) being adapted to be joined to the first and second mitred end, respectively, of said top rail (440), and that the screening arrangement furthermore includes a set of angular brackets (85), each angular bracket being adapted to cooperate with reception means in the back side of the top rail (440) and in the back side of the respective side rail (8, 9).

18. A screening arrangement according to claim 17, wherein the top rail (440) has a predetermined height and each side rail (8, 9) has a predetermined width, and wherein said predetermined height is substantially the same as said predetermined width, the mitre joint thus being a 45° mitre joint.

* * * * *